US009505536B2

(12) United States Patent
Dwork

(10) Patent No.: US 9,505,536 B2
(45) Date of Patent: Nov. 29, 2016

(54) REFLEXIVE BOX LID

(71) Applicant: Michael D. Dwork, New York, NY (US)

(72) Inventor: Michael D. Dwork, New York, NY (US)

( * ) Notice: Subject to any disclaimer, the term of this patent is extended or adjusted under 35 U.S.C. 154(b) by 0 days.

(21) Appl. No.: 14/279,942

(22) Filed: May 16, 2014

(65) Prior Publication Data

US 2015/0329256 A1 Nov. 19, 2015

(51) Int. Cl.

| | |
|---|---|
| ***B65D 5/52*** | (2006.01) |
| ***B65D 5/66*** | (2006.01) |
| ***B65D 51/24*** | (2006.01) |
| ***B65D 81/26*** | (2006.01) |

(52) U.S. Cl.

CPC ..... *B65D 51/248* (2013.01); *B65D 5/66* (2013.01); *B65D 5/6676* (2013.01); *B65D 5/6682* (2013.01); *B65D 81/26* (2013.01); *B65D 2585/366* (2013.01)

(58) Field of Classification Search

CPC .... B65D 5/66; B65D 5/6682; B65D 51/249; B65D 5/5206; B65D 5/5273; B65D 5/6676

USPC ..... 229/104, 148, 149, 902, 906, 125; 206/45.21, 45.23, 45.25

See application file for complete search history.

(56) References Cited

U.S. PATENT DOCUMENTS

| | | | | |
|---|---|---|---|---|
| 1,125,987 | A * | 1/1915 | Eichhorn | B65D 5/5206 206/45.21 |
| 1,590,683 | A * | 6/1926 | Helfrich | 206/45.21 |
| 1,789,105 | A * | 1/1931 | Lange | 428/153 |
| 1,851,518 | A * | 3/1932 | McGovern | 229/146 |
| 2,005,816 | A * | 6/1935 | Weiss | 206/45.21 |
| 2,131,093 | A * | 9/1938 | Cage | 206/45.23 |
| 3,889,868 | A * | 6/1975 | Bruckner | B65D 5/6661 229/117.16 |
| 4,313,542 | A | 2/1982 | Roberts et al. | 229/22 |
| 4,331,231 | A * | 5/1982 | Boyle | 206/45.25 |
| 5,213,255 | A | 5/1993 | Cote | 229/115 |
| 5,385,292 | A | 1/1995 | Labianca et al. | 229/120 |
| 5,445,286 | A * | 8/1995 | Guimarin | 229/117.34 |
| 5,494,214 | A * | 2/1996 | Fleury et al. | 229/149 |
| 5,799,864 | A * | 9/1998 | Mertz | 229/196 |
| 5,899,324 | A * | 5/1999 | Stone et al. | 206/45.21 |
| 8,857,701 | B2 * | 10/2014 | Mandreucci et al. | 229/104 |
| 2001/0017315 | A1 * | 8/2001 | Baroudi | 229/148 |
| 2007/0187290 | A1 | 8/2007 | Zimmerman | 206/784 |

(Continued)

FOREIGN PATENT DOCUMENTS

| | | | |
|---|---|---|---|
| FR | 2 849 642 | A1 | 7/2004 |
| GB | 2 507 064 | A | 4/2014 |
| WO | WO 2013/065012 | A1 | 5/2013 |

OTHER PUBLICATIONS

Int'l Search Report and Written Opinion issued in connection with Int'l Appl'n No. PCT/US2015/028858 on Jul. 16, 2015 (9 pages).

*Primary Examiner* — Gary Elkins

(74) *Attorney, Agent, or Firm* — Fitzpatrick, Cella, Harper & Scinto

(57) ABSTRACT

A reflexive lid having a top panel including a top-panel front section and a top-panel rear section connected along a fold line. The top panel rear section is foldably connected to a rear-panel top edge of a container, where the rear panel top edge of the container is at a height (H) above a bottom panel of the container and the fold line is a depth (D) from the rear panel top edge, wherein the depth is either one of substantially the same as height H or greater than height H.

5 Claims, 10 Drawing Sheets

(56) References Cited

U.S. PATENT DOCUMENTS

2008/0087556 A1* 4/2008 Henke et al. ..... 206/45.23
2009/0314661 A1* 12/2009 Fisher et al. ..... 206/45.21
2014/0299657 A1* 10/2014 Giudilli ..... 229/164.2
2015/0150286 A1* 6/2015 Milligan et al. ..... A23L 1/0156

* cited by examiner

REFLEXIVE BOX LID

BACKGROUND

I. Field

Example aspects described herein relate generally to containers, and more particularly to space saving containers having a reflexive lid.

II. Related Art

Referring to FIG. 1, a prior art pizza box 10 holding a pizza pie 12 is illustrated. Box 10 includes a top panel 14, a top left-side panel 16, a top right-side panel 18, a top front panel 20, a rear panel 22, a bottom panel 24, a bottom left panel 26, a bottom right panel 28, and a bottom front panel 30, all formed integrally from a single die-cut master panel (not shown). The above-mentioned panels are interlocked together to form the pizza box and define a pizza compartment 32 for holding the pizza pie 12. Although such a construction may be effective for situations where the food (e.g., a pizza pie or slices thereof) will be removed from the container and the container discarded or placed out of the way such as on a countertop, it is not always effective for use as a container from which the food can be eaten. For example when top panel 14 is open it is typically extended outwardly and away from the rear panel such that the box will take up nearly twice the space of the main compartment 32. If the top panel 14 is open such that it is substantially parallel with the bottom panel 24 it will likely collide with the plate or container of the person sitting on the other side of the table or the plate or container of the person sitting adjacent to the box. Even if the top panel 14 is not completely parallel with the bottom panel 24, it can still be annoyingly in the way. Indeed, when the top panel 14 is perpendicular to the bottom panel 24 it can create a barrier between two people wishing to converse. These obstructions make it inconvenient for two or more people sitting at a relatively small table to socially interact while eating out of such containers and can also disturb other people nearby.

BRIEF DESCRIPTION

A reflexive lid having a top panel including a top-panel front section and a top-panel rear section connected along a fold line. The top panel rear section is foldably connected to a rear-panel top edge of a container, where the rear panel top edge of the container is at a height (H) above a bottom panel of the container and the fold line is a depth (D) from the rear panel top edge, wherein the depth is either one of substantially the same as height H or greater than height H.

In one embodiment a top left-side panel having at least one cut-out tab constructed to interlock with a cut-out receiving portion of the container and a top right-side panel having at least one cut-out tab is constructed to interlock with a cut-out receiving portion of the container.

In another embodiment, a second layer panel in the form of either one of a removable or washable material, the second layer panel being removably affixed to a side of the top panel facing the compartment of the container.

In yet another embodiment, the top panel is made from any one or a combination of cardboard, plastic, wood or bagasse.

The fold line can be a line of weakness formed by any one or a combination of intermittent cuts, incisions or impressions.

A panel, such as the top-panel front section and the top-panel rear section can be connected by a hinged connection.

BRIEF DESCRIPTION OF THE DRAWINGS

The features and advantages of the example embodiments of the invention presented herein will become more apparent from the detailed description set forth below when taken in conjunction with the following drawings.

DETAILED DESCRIPTION

Figure 1:
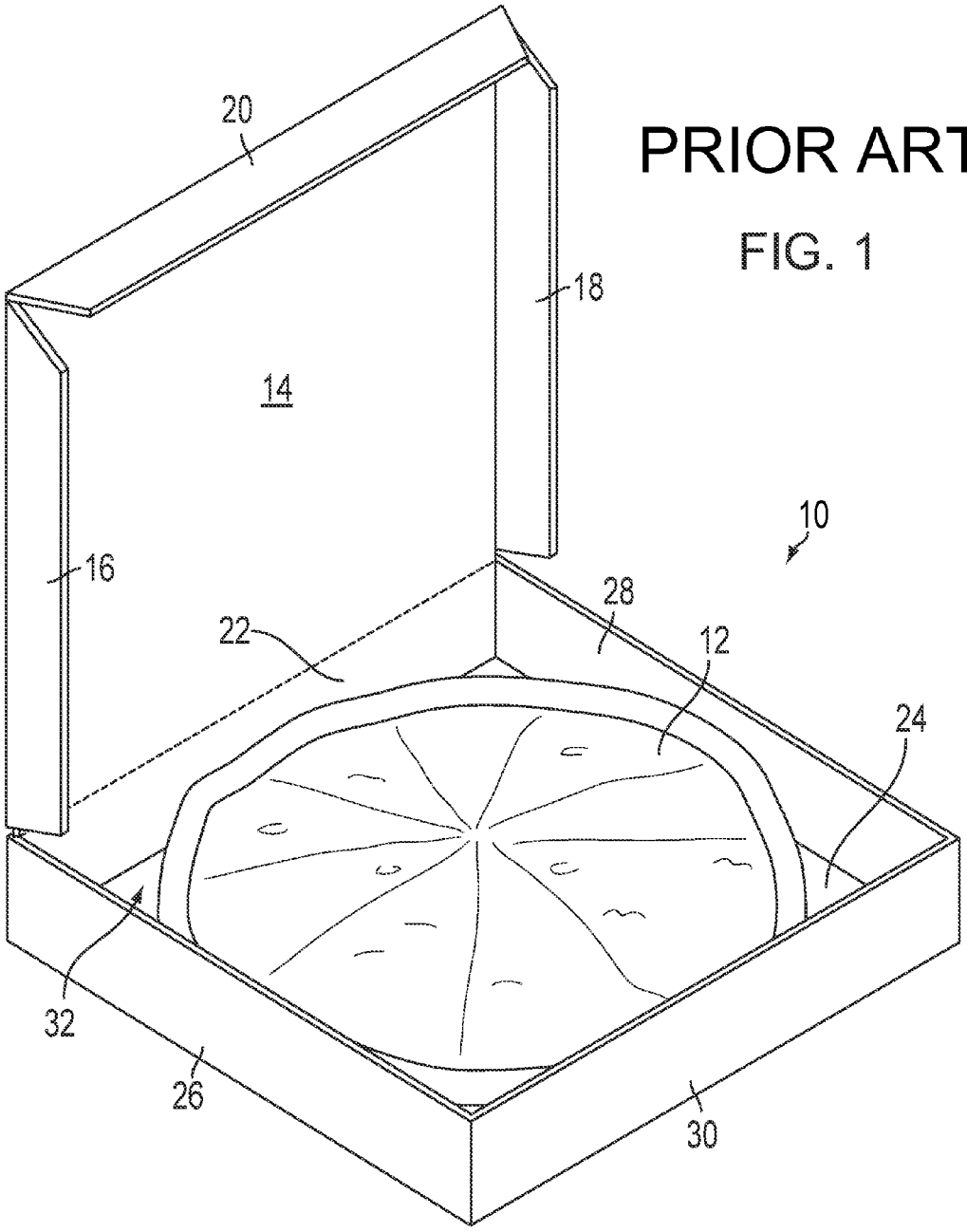
PRIOR ART FIG. 1
FIG. 1 is a perspective view of a prior art open pizza pie box.
Figure 2:
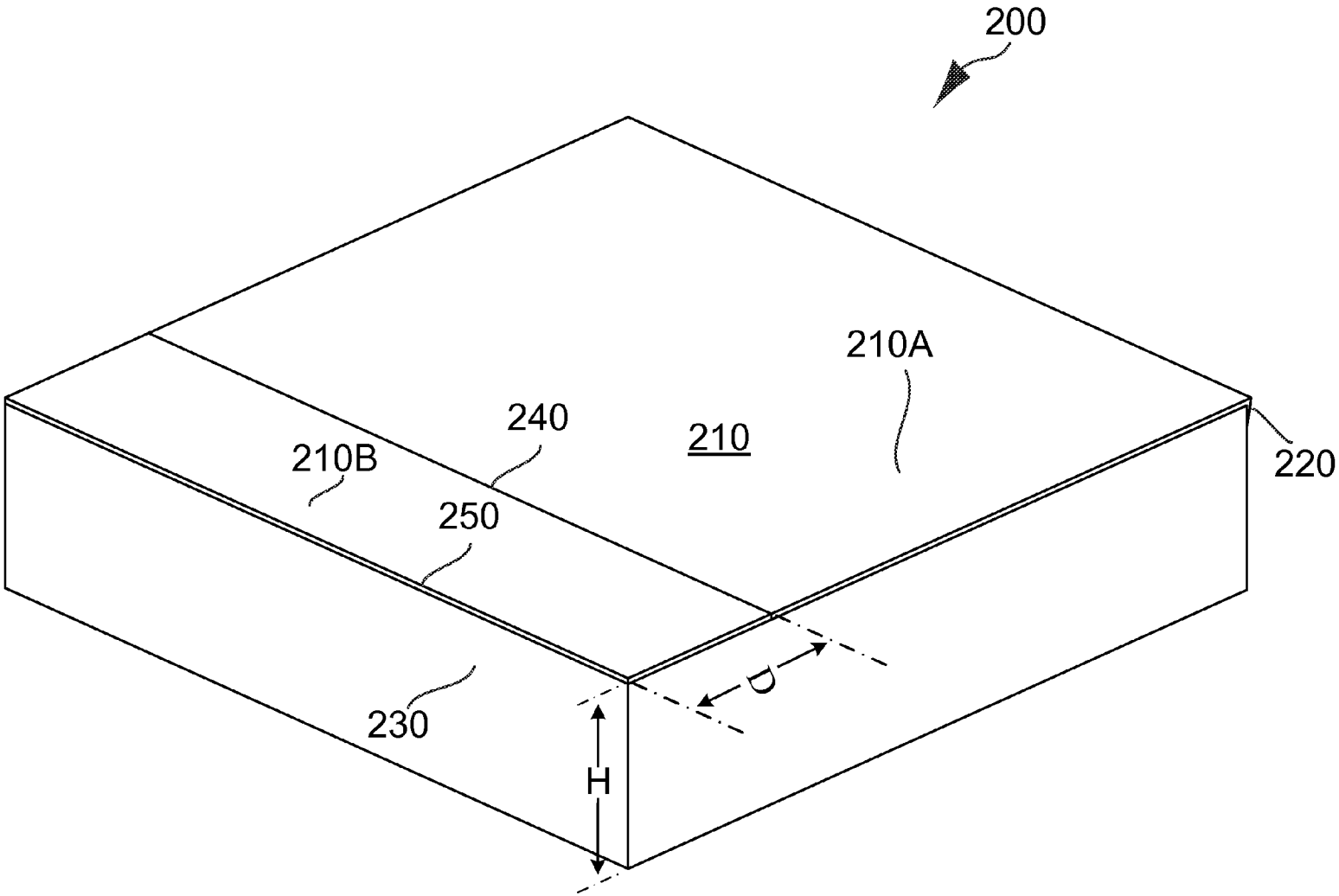
FIG. 2 is a top-rear perspective view of a container in accordance with an embodiment of the present invention, with the top panel in the closed configuration.
Figure 3:
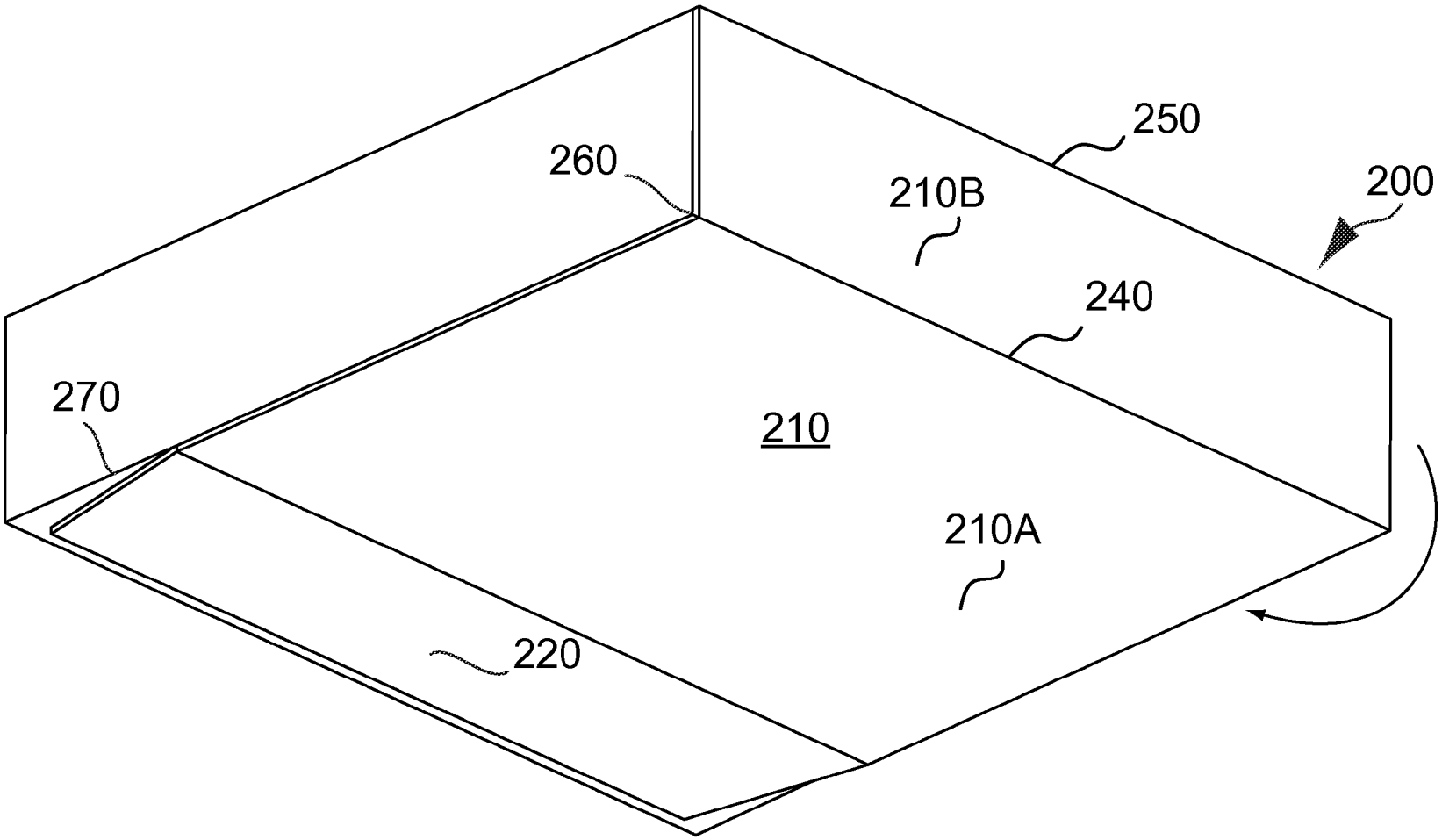
FIG. 3 is a bottom perspective view of a container in accordance with an embodiment of the present invention, with the top panel in the open configuration.
Figure 4:
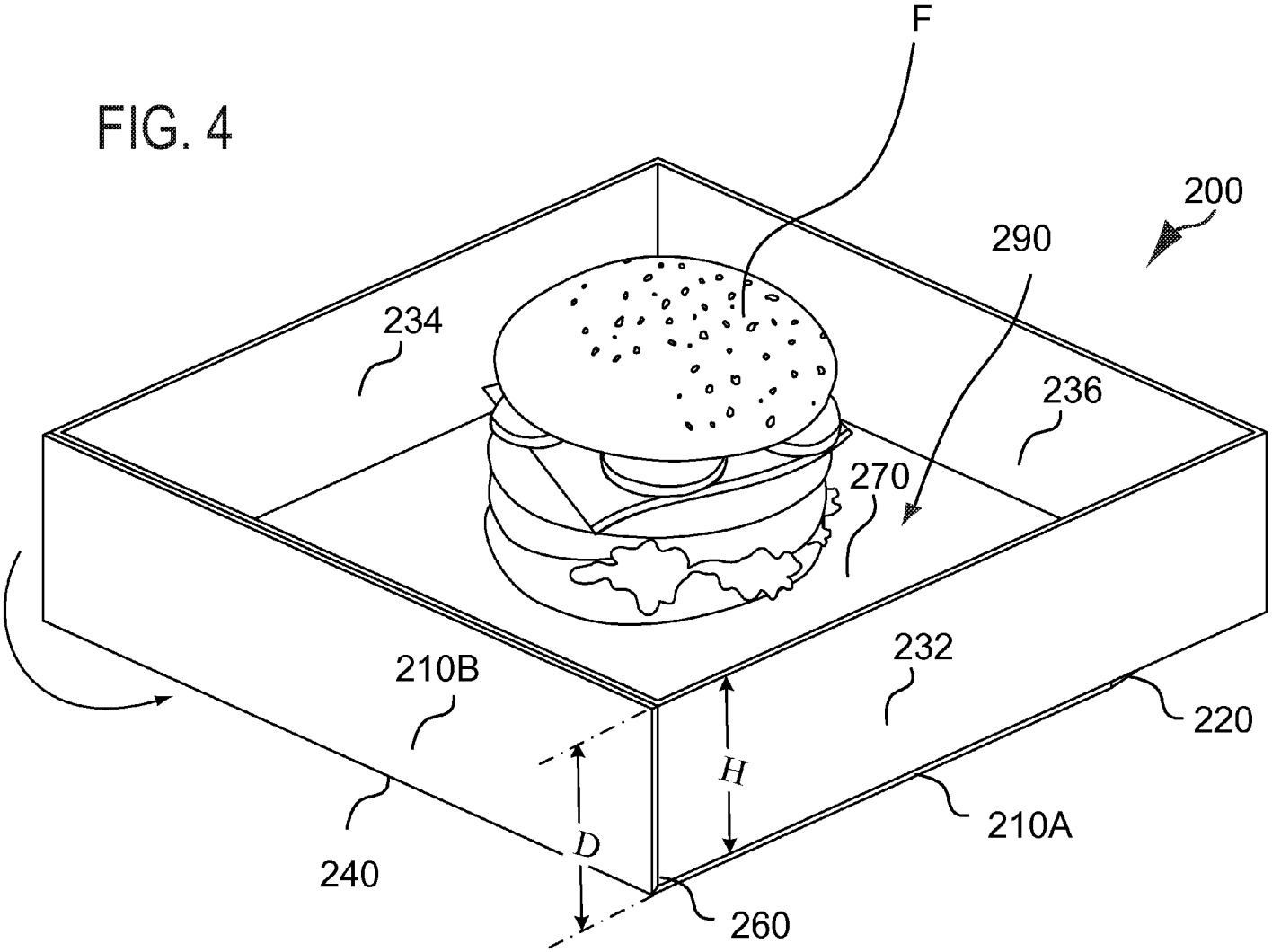
FIG. 4 is a top-rear perspective view of a container in accordance with an embodiment of the present invention with the top panel in the open configuration.

Referring to FIGS. 2-4, a container 200 in accordance with an example embodiment of the present invention is illustrated. FIG. 2 is a top-rear perspective view of container 200 with the top panel in the closed configuration. FIG. 3 is a bottom perspective view of container 200 with the top panel in the open configuration. FIG. 4 is a top-rear perspective view of container 200 with the top panel in the open configuration.

Container 200 includes a top panel (or lid) 210, a top front panel 220, a rear panel 230 foldably coupled to the top panel 210, a bottom panel 270, a bottom left panel 232, a bottom right panel 234, and a bottom front panel 236. All the panels can be formed integrally from a single die-cut master panel (not shown) and made of cardboard such as card stock, corrugated fiberboard, paperboard or a material having similar properties, such as plastic, wood and bagasse (e.g., sugar cane fiber).

Alternatively, one or more of the panels can also be formed separately and hingedly attached. For example, the top panel 210 can be attached to the rear panel 230. Similarly, the top-panel front section 210A and the top-panel rear section 210B can be connected by a hinged connection. If the container is made from plastic, for example, plastic hinges can be made by a method of injection molding and used to connect the panels.

The above-mentioned panels are interlocked together to form a container and define a compartment 290 for holding contents such as food (F in FIG. 4) or other (e.g., non-edible) contents.

In this embodiment top panel 210 has two sections, a top-panel front section 210A and a top-panel rear section 210B, where the top-panel front section 210A and the top-panel rear section 210B are connected along a fold line 240. As shown in FIG. 2, the rear panel 230 has a height H. Fold line 240 has a depth (D) from the rear-panel top edge 250 which can be the same or substantially the same as height H. Adding a delta (Δ) such that D=H+Δ accounts for any material at the rear-panel top edge 250 that does not fold back and/or the additional length needed to fold under bottom panel 270. Adding the delta (Δ) can be used to reduce or eliminate tearing of the rear panel 230 or weakening of fold line 240 when the top panel is open.

Fold line 240 can be formed by intermittent cuts or incisions or by forming impressions into the container material such that a line of weakness is formed. In this embodiment top panel 210 is not coupled to a top left-side panel or a top right-side panel.

As shown in FIG. 3, top panel 210 is folded back over the rear panel edge 250 such that fold line 240 is substantially aligned with a rear-panel bottom edge 260 of rear panel 230 and top-panel front section 210A, and top front panel 220 are situated adjacent to bottom panel 270 of container 200.

As shown in FIG. 4, the top panel 210 can be folded back such that fold line 240 substantially aligns with the rear-panel bottom edge 260 of the rear panel 230 (FIG. 2), top-panel rear section 210B is situated adjacent to rear panel 230, and top-panel front section 210A and top front panel 220 are situated adjacent to bottom panel 270 thereby exposing a compartment 290. As shown in this example embodiment compartment 290 has been used for containing food (F). Other (e.g., non-edible) contents can be placed in compartment 290 in combination with or instead of food F as well.

Figure 5:
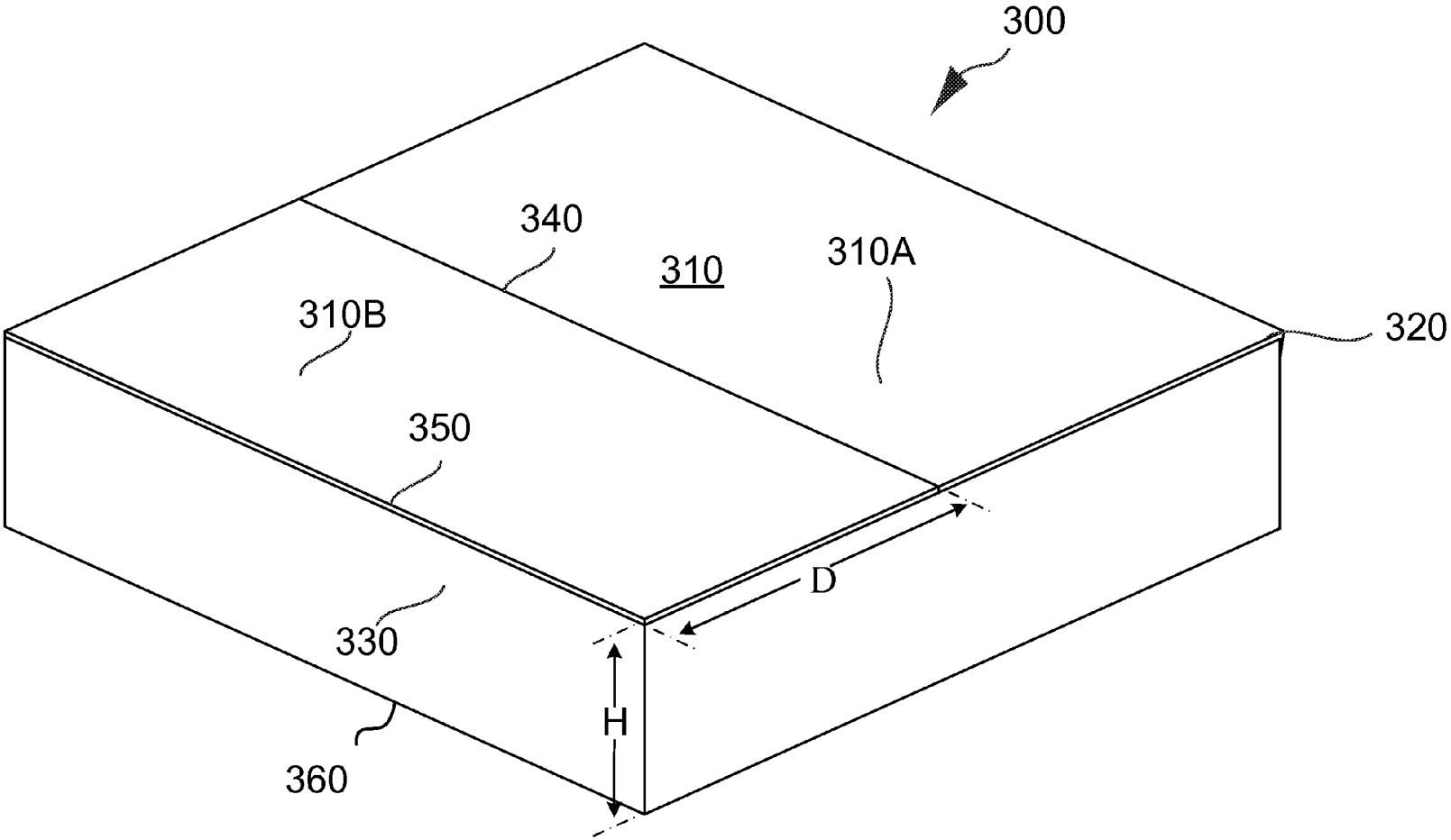
FIG. 5 is a top-rear perspective view of a container in accordance with an embodiment of the present invention, with the top panel in the closed configuration.
Figure 6:
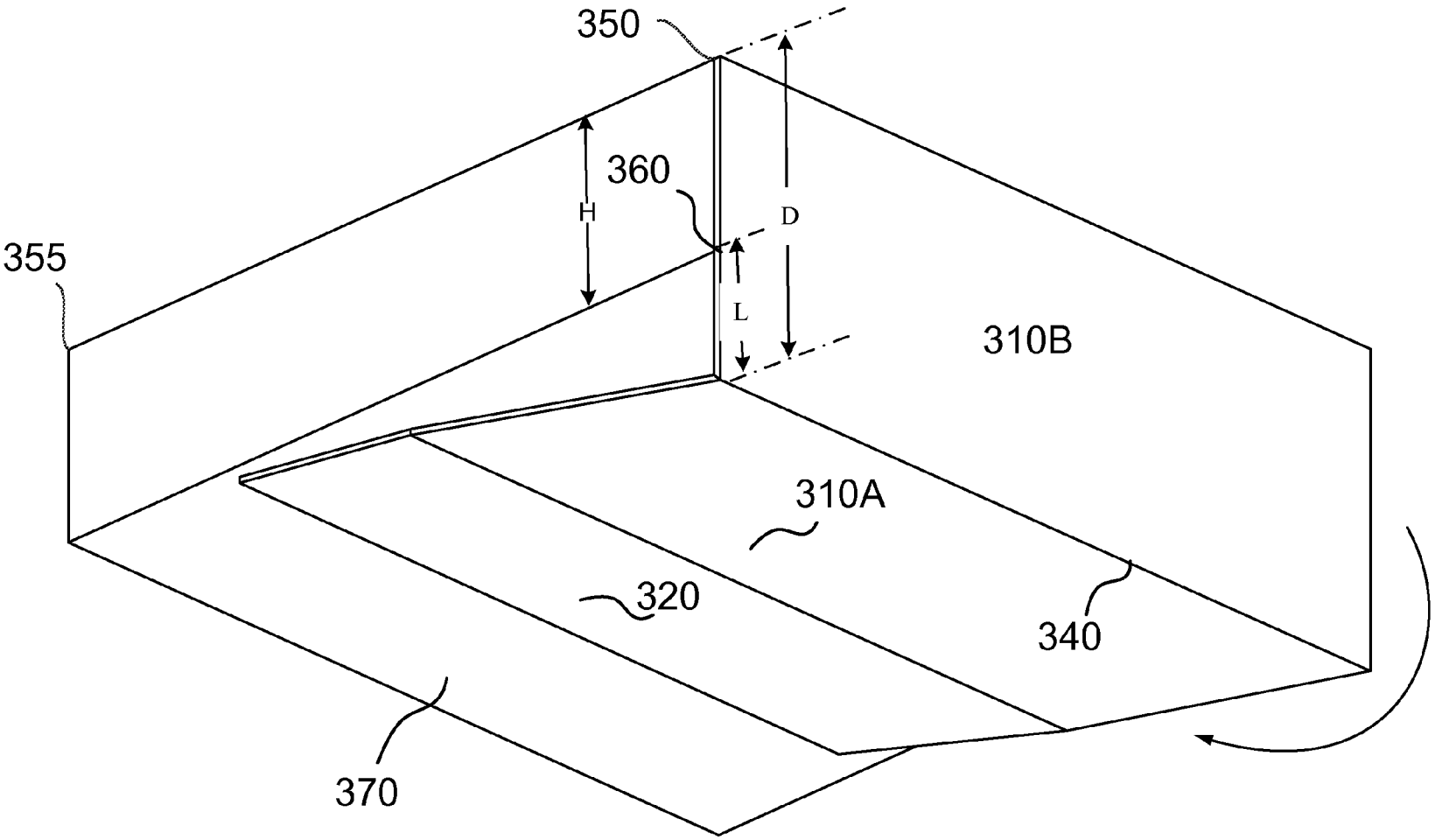
FIG. 6 is a bottom perspective view of a container in accordance with an embodiment of the present invention, with the top panel in the open configuration.
Figure 7:
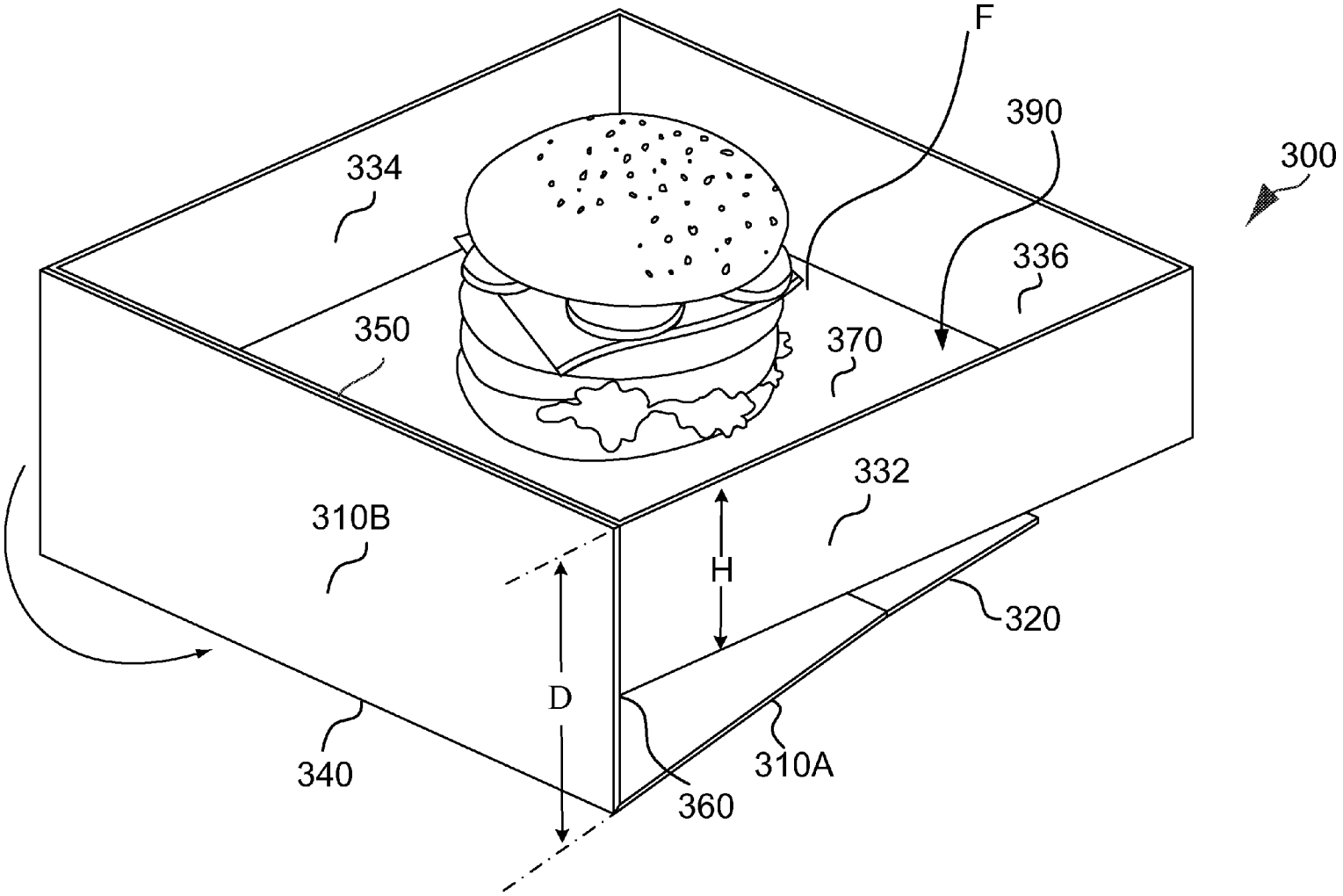
FIG. 7 is a top-rear perspective view of a container in accordance with an embodiment of the present invention, with the top panel in the open configuration.

Referring to FIGS. 5-7, a container 300 in accordance with an example embodiment of the present invention is illustrated. FIG. 5 is a top-rear perspective view of container 300 with the top panel in the closed configuration. FIG. 6 is a bottom perspective view of container 300 with the top panel in the open configuration. FIG. 7 is a top-rear perspective view of container 300 with the top panel in the open configuration.

Container 300 includes a top panel 310, a top front panel 320, a rear panel 330 foldably coupled to the top panel 310, a bottom panel 370, a bottom left panel 332, a bottom right panel 334, and a bottom front panel 336. All the panels can be formed integrally from a single die-cut master panel (not shown) and made of cardboard such as card stock, corrugated fiberboard, paperboard or a material having similar properties, such as plastic, wood and bagasse (e.g., sugar cane fiber).

Alternatively, one or more of the panels can also be formed separately and hingedly attached. For example, the top panel 310 can be attached to the rear panel 330. Similarly, the top-panel front section 310A and the top-panel rear section 310B can be connected by a hinged connection. If the container is made from plastic, for example, plastic hinges can be made by a method of injection molding.

The above-mentioned panels are interlocked together to form a container and define a compartment 390 for holding contents such as food (F in FIG. 7). In this embodiment the top panel 310 has two sections, a top-panel front section 310A and a top-panel rear section 310B, where the top-panel front section 310A and the top-panel rear section 310B are connected along a fold line 340. As shown in FIG. 5, the rear panel 330 has a height H. Fold line 340 has a depth (D) from the rear-panel top edge 350, a distance substantially greater than height H. That is, the distance from the fold line 340 to the top edge of rear panel edge 350 is depth D, where D is greater than H.

Fold line 340 can be formed by intermittent cuts or incisions or by forming impressions into the container material such that a line of weakness is formed. This embodiment allows the compartment 390 of container 300 to be set at an angle relative to the surface on which it is placed such that the rear of container rear-panel top edge 350 is higher than the front-panel top edge 355.

Referring to FIG. 6, top panel 310 is folded back over the rear panel edge 350 such that fold line 340 extends a length L=D−H from rear panel bottom edge 360. Top-panel front section 310A and top front panel 320 are beneath bottom panel 370 of container 300 such that top panel rear section 310B is angled downward towards bottom panel 370. Top front panel 320 lies flat against bottom panel 370.

As shown in FIG. 7, the top panel 310 can be folded back such that fold line 340 extends below the rear panel bottom edge 360 of the rear panel 330 (FIG. 5). Compartment 390 is exposed in this configuration of container 300. As shown in this example embodiment, the compartment has been used for containing food (F). As noted above, it should be understood that non-edible contents also can be placed in the embodiments described herein and that they are not limited to being used to contain only food.

Figure 8:
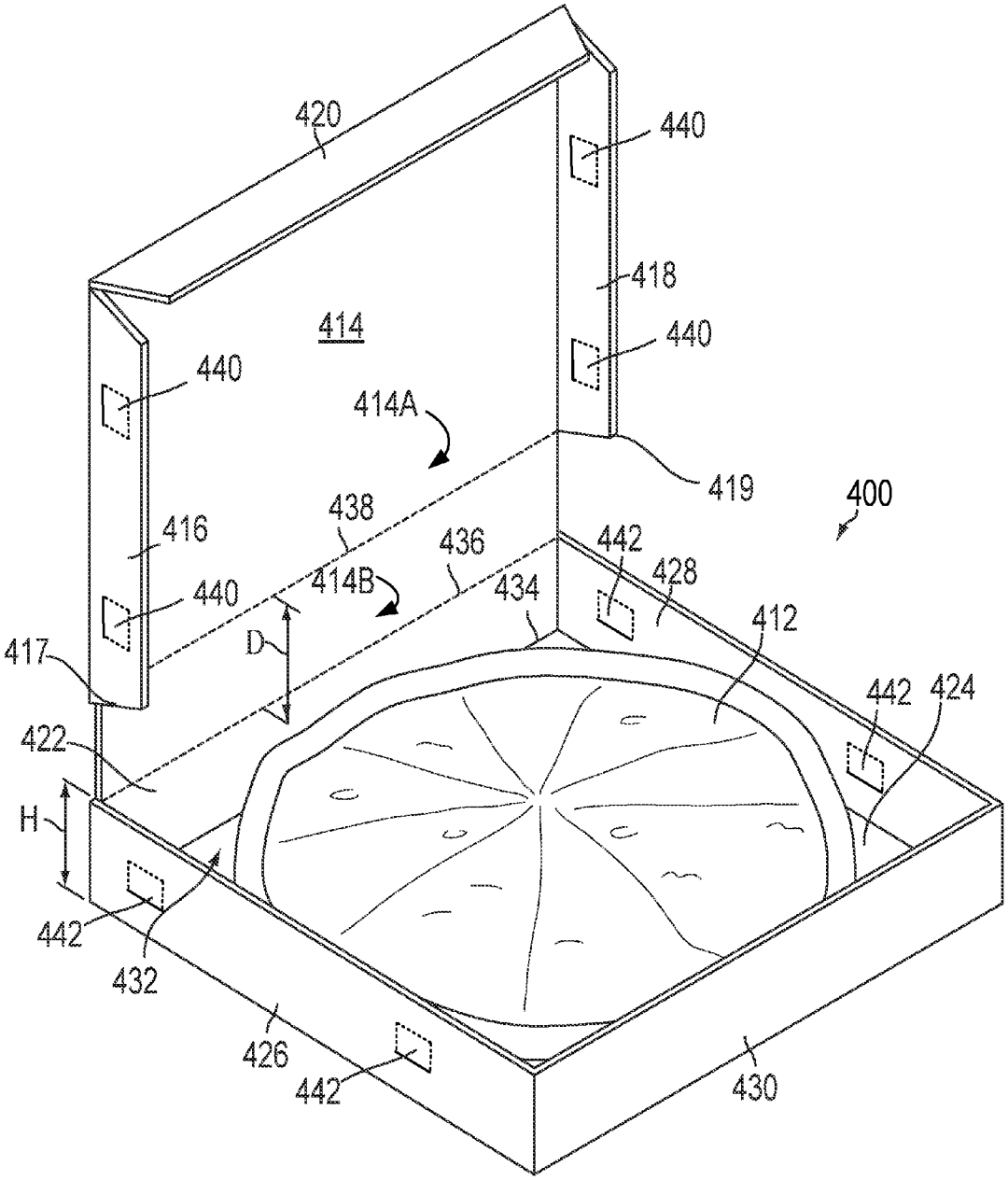
FIG. 8 is a top perspective view of an open pizza pie box in accordance with an embodiment of the present invention, with the top panel in the open configuration.

FIG. 8 is a top perspective view of an exemplary container such as a pizza box 400 in accordance with the present invention. Referring to FIG. 8, a pizza box 400 holding a pizza pie 412 in accordance with an example embodiment of the present invention is illustrated. Box 400 includes a top panel 414 having a top left-side panel 416, a top right-side panel 418, a top front panel 420, a rear panel 422, a bottom panel 424, a bottom left panel 426, a bottom right panel 428, and a bottom front panel 430, all formed integrally from a single die-cut master panel (not shown). The above-mentioned panels are interlocked together to form the pizza box and define a pizza compartment 432 for holding a pizza pie 412. In this embodiment the top panel 414 has two sections, a top-panel front section 414A and a top-panel rear section 414B, where the top-panel front section 414A and the top-panel rear section 414B are connected along fold line 438. As shown in FIG. 8, the rear panel 422 has a height of H and the depth (D) from fold line 438 to rear panel top edge 436 is approximately the same as height H. This allows the top panel 414 to be folded back such that fold line 438 substantially aligns with the rear panel bottom edge 434 of rear panel 422. When folded underneath, top-panel front 414A and top front panel 420 are situated beneath the pizza compartment 432 as shown in FIG. 8.

As shown in FIG. 8, the top left-side panel 416 and the top right-side panel 418 have a top left-side panel rear edge 417 and top right-side panel rear edge 419, respectively, which are approximately aligned with fold line 438. In this configuration, when the top panel 414 is folded backwardly over rear panel top edge 436, the side panels will not appear as fins extended from rear panel 422. Optionally, the top left-side panel rear edge 417 and top right-side panel rear edge 419 can extend down closer to rear panel top edge 436.

Optionally, top left-side panel 416 and top right-side panel 418 each have one or more cut-out tabs 440 that can be pushed out and used to secure or lock top left-side panel 416 and top right-side panel 418 to a bottom left panel 426 and bottom right panel 428, respectively, when the top panel 414 is in the open configuration and folded underneath compartment 432. Bottom left panel 426 and bottom right panel 428 each have corresponding cut-out receiving portions 442, which are used to receive cut-out tabs 440.

In FIG. 8 with respect to the cut-out tabs 440, the solid lines represent folds that can be formed by intermittent cuts or incisions or by forming impressions into the container material such that a line of weakness is formed. Also with respect to cut-out tabs 440, the dashed lines represent intermittent cuts or incisions that are formed into the container material such that the tabs can be pushed out. Such cut-out tabs 440 are also referred to sometimes as tongues or flaps. In this embodiment cut-out receiving portions 442 can be used as heat vents as well.

Figure 9:
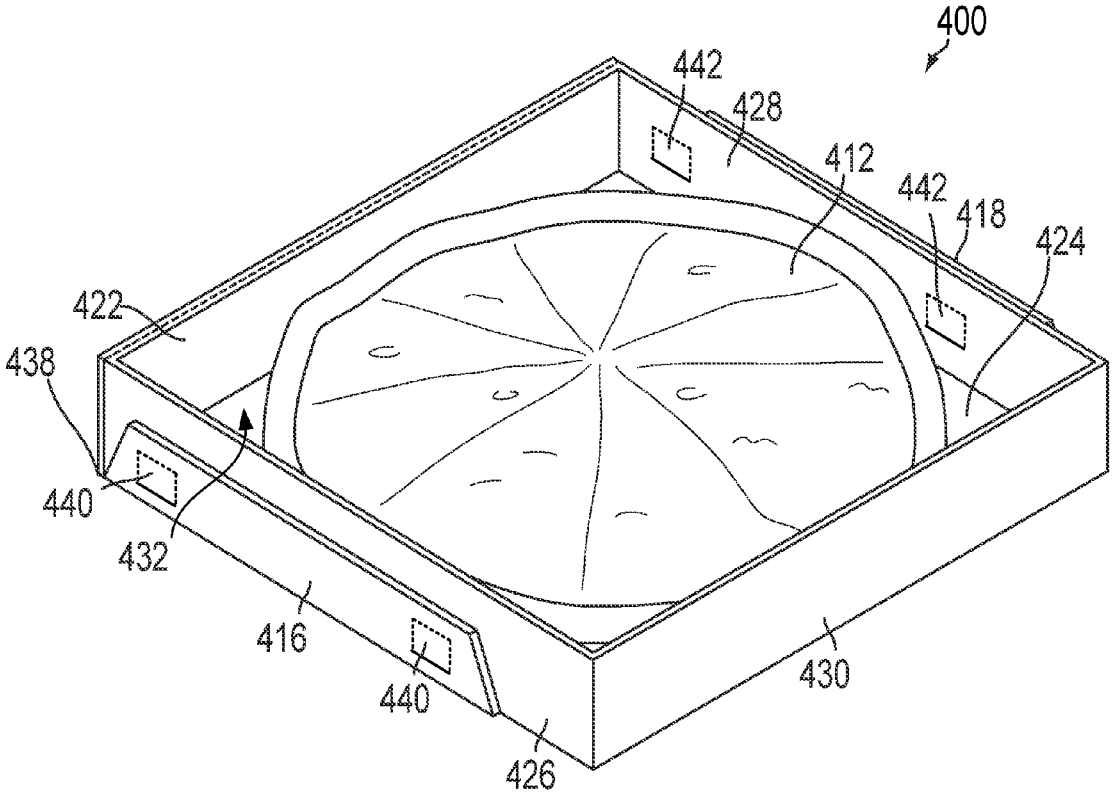
FIG. 9 is a top perspective view of an open pizza pie box in accordance with an embodiment of the present invention, with the top panel in the open configuration.

FIG. 9 is a top perspective view of container 400 described above in connection with FIG. 8, with the top panel 414 in the open configuration and folded beneath compartment 432. As shown in FIG. 9, the top panel 414 is folded back such that fold line 438 substantially aligns with the rear panel bottom edge 434 (FIG. 8) of the rear panel 422. In this embodiment top left side panel 416 and top right side panel 418 extend along the outside of compartment 432 and are locked in place using a locking mechanism such as the one described above with respect to cut-out tabs 440 and cut-out receiving portions 442.

It should be understood that other securing or locking mechanisms can be used instead of cut-out tabs 440 and cut-out receiving portions 442 and still be within the scope of the subject embodiment. For example, interlocking tongues can be used in conjunction with slits cut out in corresponding positions along bottom left panel 426 and bottom right panel 428 such that the tongues can be inserted through or otherwise engage the slits.

Although the example embodiment illustrated in FIGS. 2-9 form a cuboid shape, it is understood that the present invention can be applied to any type and shape of package for carrying any type and shape of contents.

Figure 10:
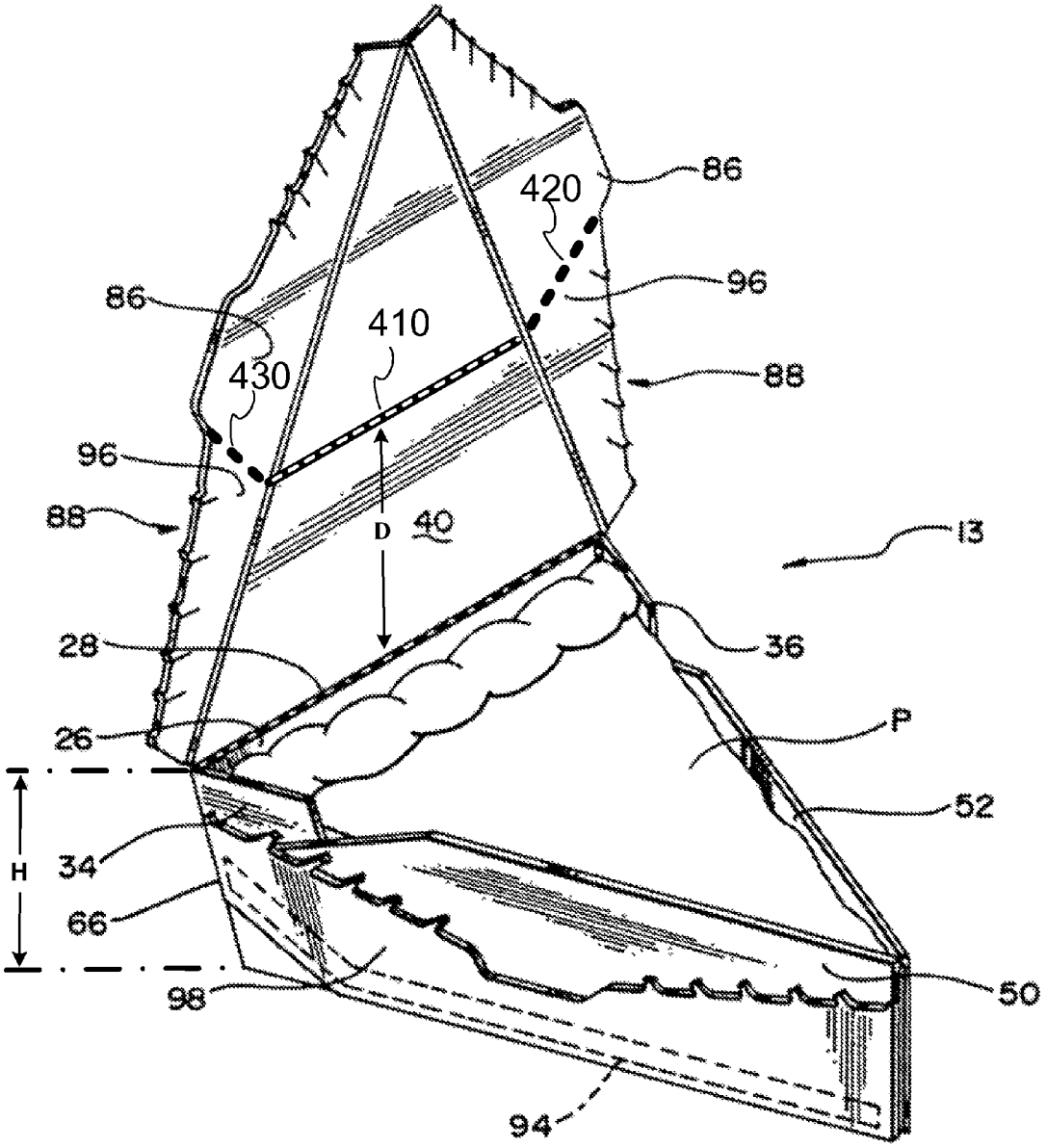
FIG. 10 is a perspective view of a container opened, showing a pie therein, in accordance with an embodiment of the present invention.

FIG. 10 is a top perspective view of a wedge shaped container in accordance with an embodiment of the present invention. As shown in FIG. 10, container 13 is unsealed. A generally rectangular, trapezoidal, rear end wall panel 26 is foldably connected to bottom panel (not shown) along the lower base edge (not shown). The rear wall 26 has an upper base edge 28 that is generally parallel to the lower base edge. The rear panel 26 also has non-parallel side edges (not shown). A minor rear closure panel 34, 36 is foldably connected to each side edge of the rear panel 26, respectively.

Container 13 also includes a bilateral opening structure in each of the outer side wall panels 66. Only one outer side wall panel 66 is shown. The structure includes a generally central, deflectable, finger operated opening tab 86 defined by a cut in each side wall panel 66. A line of weakness 88 extends from each end of the tab 86 generally across and along the central longitudinal length of each side wall panel 66. Adhesive or glue areas 94 are provided on each outer side wall panel 66. As shown in FIG. 10, a consumer's finger may be inserted behind the opening tab 86 in each outer side wall panel 66 by slight deflection of the tab 86 and the adjacent inner side wall panel 50 or 52. A generally upward and outward lifting or tearing force applied to the finger opening tab 86 causes the separation of a generally upper portion 96 of the outer side wall panel 66 from a lower portion 98 thereof along the line of weakness 88. The lower portions 98 of the outer side wall panels 66 remain affixed to the inner side wall panels 50, 52. Once this is done on both sides, the top panel 40 may then be rotated along the upper base edge 28 to the position depicted in FIG. 10, wherein the piece of pie P in the container 13 is exposed.

It should be appreciated that the carton material comprising the top panel 40 and the upper portions 96 of the outer side wall panel 66 may be, if desired, removed from the remainder of the carton 13 along the upper base edge 28 by tearing along that edge 28. However, it is anticipated that most users will leave the opened carton 13 intact, using it as a tray or dish. When using the opened carton 13 intact, as a tray or dish, fold lines 410, 430 and 420 allow top panel 40 to be folded backwardly and underneath the compartment holding pie P in a similar manner as discussed above with respect to FIGS. 2-9.

In another optional embodiment, second layer panel in the form of a removable or washable material can be placed on the bottom side of the top panel 210 (FIGS. 2-4); 310 (FIGS. 5-7); 414 (FIG. 8-9); or 40 (FIG. 10): specifically, the side of the top panel that is facing the compartment. This allows the side facing the contents of the container to remain cleaner than it would have been if it were placed in contact with an unclean surface. This optional feature can be used for situations in which the container is reused (e.g., to carry leftovers). In one exemplary embodiment a removable or washable layer can be a wax paper-like material that is affixed onto the compartment facing side of the front panel such that it can be torn off exposing a cleaner surface. In another example embodiment, layers of material that can be peeled off one at a time can be affixed to the panel.

While various example embodiments of the present invention have been described above, it should be understood that they have been presented by way of example, and not limitation. It will be apparent to persons skilled in the relevant art(s) that various changes in form and detail can be made therein. Thus, the present invention should not be limited by any of the above described example embodiments, but should be defined only in accordance with the following claims and their equivalents.

In addition, it should be understood that the FIGS. 2-10 are presented for example purposes only. The architecture of the example embodiments presented herein is sufficiently flexible and configurable, such that it may be utilized in ways other than that shown in the accompanying figures.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the example embodiments presented herein in any way.

What is claimed is:

1. A container including a reflexive lid, said container comprising:

a lid top panel including a top-panel front section and a top-panel rear section connected along a fold line;

a lid front panel foldably connected to the top panel and configured to extend downwardly from the lid top panel when the container is closed;

a rear-panel foldably connected at a top edge to the top-panel rear section, wherein the rear-panel top edge is at a height (H) above a bottom panel of the container and the fold line is a depth (D) from the rear-panel top edge, wherein the depth D is substantially the same as the height H; and said lid top panel positioned with the fold line aligning with a rear-panel bottom edge and with the entire surface of the top-panel front section and the entire surface of the front panel against the bottom panel.

2. The container of claim 1, further comprising:

a first cut-out receiving portion;

a second cut-out receiving portion;

a top left-side panel having at least one cut-out tab constructed to interlock with the first cut-out receiving portion; and a top right-side panel having at least one cut-out tab constructed to interlock with the second cut-out receiving portion.

3. The container of claim 1, wherein the lid top panel is made from any one or a combination of cardboard, plastic, wood or bagasse.

4. The container of claim 1, wherein the fold line is a line of weakness formed by any one or a combination of intermittent cuts, incisions or impressions.

5. The container of claim 1, wherein the top-panel front section and the top-panel rear section are connected by a hinged connection.

* * * * *